United States Patent [19]

Hall et al.

[11] Patent Number: 4,737,450

[45] Date of Patent: Apr. 12, 1988

[54] METHOD FOR BLEACH-FIXING OF PHOTOGRAPHIC ELEMENTS

[75] Inventors: Jeffrey L. Hall, Rochester; Jacob J. Hastreiter, Jr., Spencerport, both of N.Y.

[73] Assignee: Eastman Kodak Company, Rochester, N.Y.

[21] Appl. No.: 11,574

[22] Filed: Feb. 6, 1987

Related U.S. Application Data

[62] Division of Ser. No. 853,329, Apr. 18, 1986.

[51] Int. Cl.[4] ..... G03C 5/38; G03C 7/00

[52] U.S. Cl. ..... 430/460; 252/102; 252/186.3; 252/186.27; 252/186.43; 430/393; 430/418; 430/430; 430/455; 430/461; 430/943

[58] Field of Search ..... 430/460, 393, 418, 430, 430/943, 461, 455; 252/102, 186.3, 186.27, 186.43

[56] References Cited

U.S. PATENT DOCUMENTS

| | | | |
|---|---|---|---|
| 4,138,478 | 3/1979 | Reese et al. | 424/62 |
| 4,231,890 | 4/1980 | Yagi et al. | 252/186 |
| 4,277,556 | 3/1981 | Koboshi et al. | 430/393 |
| 4,301,236 | 7/1981 | Idota et al. | 430/393 |
| 4,328,306 | 1/1982 | Idota et al. | 430/393 |
| 4,347,149 | 6/1982 | Smith et al. | 252/102 |
| 4,362,639 | 11/1982 | Eoga | 252/99 |
| 4,378,300 | 3/1983 | Gray | 252/99 |
| 4,454,224 | 10/1984 | Brien et al. | 430/393 |
| 4,529,534 | 7/1985 | Richardson | 252/100 |

FOREIGN PATENT DOCUMENTS

| | | | |
|---|---|---|---|
| 2330579 | 1/1975 | Fed. Rep. of Germany | 430/460 |
| 0075932 | 7/1978 | Japan | 430/460 |
| 1041367 | 5/1986 | Japan . | |

*Primary Examiner*—Mukund J. Shah

*Attorney, Agent, or Firm*—Alfred P. Lorenzo

[57] ABSTRACT

A method for the processing of photographic elements includes a bleach-fixing step utilizing a bleach-fixing composition comprising an aqueous alkaline solution of a peroxy compound and an ammonium or amine salt of a weak acid.

9 Claims, No Drawings

METHOD FOR BLEACH-FIXING OF PHOTOGRAPHIC ELEMENTS

This is a division of application Ser. No. 853,329, filed Apr. 18, 1986, now allowed.

FIELD OF THE INVENTION

This invention relates in general to photographic processing and in particular to methods and compositions for the bleach-fixing of photographic elements. More specifically, this invention relates to a novel, ecologically advantageous bleach-fixing composition and to its use in the processing of photographic color materials.

BACKGROUND OF THE INVENTION

In the production of color photographic images, it is usually necessary to remove the silver image which is formed coincident with the dye image. This can be done by oxidizing the silver by means of a suitable oxidizing agent, commonly referred to as a bleaching agent, in the presence of halide ion, followed by dissolving the silver halide so formed in a silver halide solvent, commonly referred to as a fixing agent. Alternatively, the bleaching agent and fixing agent can be combined in a bleach-fixing solution and the silver removed in one step by use of such solution.

In the reversal processing of black-and-white photographic materials, a bleaching step is also utilized to remove photographically developed silver.

A wide variety of bleaching agents are known for use in photographic processing, for example, ferricyanide bleaching agents, persulfate bleaching agents, dichromate bleaching agents, permanganate bleaching agents, ferric chloride, and water-soluble quinones. A particularly important class of bleaching agents are the aminopolycarboxylic acid bleaching agents, such as an ammonium or alkali metal salt of a ferric complex of ethylenediaminetetraacetic acid. These complexes are used in both bleach compositions and bleach-fix compositions.

It is also well known to use peroxy compounds, such as hydrogen peroxide, as bleaching agents in both bleach compositions and bleach-fix compositions. Thus, for example, Koboshi et al, U.S. Pat. No. 4,277,556, issued July 7, 1981, describes a photographic bleach-fixing composition which is an acidic aqueous solution containing hydrogen peroxide and certain organic acids or alkali metal salts thereof; Idota et al, U.S. Pat. No. 4,301,236 issued Nov. 17, 1981, describes a photographic bleaching composition which is an aqueous solution containing hydrogen peroxide, an organometallic complex salt, and an aromatic sulfonic acid or salt thereof; Idota et al, U.S. Pat. No. 4,328,306 issued May 4, 1982, describes a method of bleaching with hydrogen peroxide and an organometallic complex salt utilizing a replenisher composed of a first composition containing the hydrogen peroxide and a second composition containing the organometallic complex salt; and Brien et al, U.S. Pat. No. 4,454,224 issued June 12, 1984 describes a photographic bleaching composition containing a peroxy compound, such as hydrogen peroxide, a buffering agent, such as potassium carbonate, and a polyacetic acid such as 2-hydroxy-trimethylenedinitrilo tetraacetic acid.

Bleaching and bleach-fixing compositions known heretofore suffer from serious disadvantages which significantly limit their usefulness in photographic processing. For example, ferricyanide bleaching agents are very effective but create substantial difficulties in regard to safe disposal. Persulfate bleaching agents and aminopolycarboxylic acid bleaching agents are preferred from an ecological point of view because they present fewer problems in regard to disposal of waste processing solutions in which they are present. However, the persulfate bleaching agents and aminopolycarboxylic acid bleaching agents suffer from the disadvantage that they provide a bleaching action which is undesirably slow for use in many photographic processes, and frequently require the use of a bleach accelerating agent.

Peroxy compounds are especially useful as bleaching agents as they are highly effective and of low cost, and they are especially beneficial in that no ecologically disadvantageous by-products result from their use.

It is toward the objective of providing a particularly simple and effective bleach-fixing composition utilizing a peroxy compound that the present invention is directed.

SUMMARY OF THE INVENTION

In accordance with this invention, a photographic bleach-fixing composition comprises an aqueous alkaline solution of a peroxy compound and an ammonium or amine salt of a weak acid. Such composition is especially advantageous in that it is prepared from inexpensive materials, is fast acting and effective, and forms no by-products which are ecologically harmful. It is useful in any photographic processing method in which it is desired to carry out the bleaching and fixing functions in a single step.

DESCRIPTION OF THE PREFERRED EMBODIMENTS

The bleach-fixing compositions of this invention are aqueous alkaline solutions typically having a pH in the range of from about 8 to about 12 and more preferably in the range of from about 9 to about 11.

The bleach-fixing compositions contain, as an essential component, a peroxy compound, that is, a compound characterized by the presence of the —O—O— group in the molecule. Useful peroxy compounds include hydrogen peroxide, alkali metal perborates, and alkali metal percarbonates. Hydrogen peroxide is preferred because it is readily available and of low cost.

The peroxy compound functions in the composition as an oxidizing agent, while the ammonium or amine salt functions as a buffer and silver ion complexing agent.

The salts employed in the bleach-fixing compositions of this invention can be ammonium salts or salts of amines such as methyl amine, ethanolamine, diethanolamine, triethanolamine, diethylaminoethanol, ethylenediamine, and the like. The useful salts are ammonium or amine salts of weak acids such as carbonic acid, phosphoric acid, sulfurous acid, boric acid, formic acid, acetic acid, propionic acid, malonic acid, succinic acid, and the like. Salts of carbonic acid are preferred, and ammonium carbonate is especially preferred.

In addition to the peroxy compound and the ammonium or amine salt of a weak acid, the bleach-fixing composition can contain an alkaline buffering agent, such as an hydroxide, which serves to maintain the desired alkaline pH. It is particularly preferred to use ammonium hydroxide for this purpose.

In preparing the bleach-fixing composition, the ingredients described above are dissolved in water in a suitable concentration. Typically, the peroxy compound is utilized in an amount of from about 0.5 to about 50 and more preferably about 2 to about 10 grams per liter of bleach-fix solution, and the ammonium or amine salt is utilized in an amount of from about 1 to about 200 and more preferably about 10 to about 100 grams per liter of bleach-fix solution.

The bleach-fixing compositions of this invention are especially useful in the color processing of photographic elements, particularly reflection print materials having a resin-coated photographic paper support. Such materials are typically processed in a two-step process—comprising the steps of color developing and bleach-fixing—or a three-step process—comprising the steps of color developing, bleach-fixing and stabilizing. The processing is typically carried out using a color developing solution which contains a primary aromatic amino color developing agent. These color developing agents are well known and widely used in a variety of color photographic processes. They include aminophenols and p-phenylenediamines.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene, and the like.

Particularly useful primary aromatic amino color developing agents are the p-phenylenediamines and especially the N-N-dialkyl-p-phenylenediamines in which the alkyl groups or the aromatic nucleus can be substituted or unsubstituted. Examples of useful p-phenylenediamine color developing agents include:

N-N-diethyl-p-phenylenediamine monohydrochloride,

4-N,N-diethyl-2-methylphenylenediamine monohydrochloride, 4-(N-ethyl-N-2-methanesulfonylaminoethyl)-2-methylphenylenediamine sesquisulfate monohydrate, 4-(N-ethyl-N-2-hydroxyethyl)-2-methylphenylenediamine sulfate, 4-N,N-diethyl-2,2'-methanesulfonylaminoethylphenylenediamine hydrochloride, and the like.

In addition to the primary aromatic amino color developing agent, color developing solutions typically contain a variety of other agents such as alkalies to control pH, bromides, iodides, benzyl alcohol, anti-oxidants, anti-foggants, solubilizing agents, brightening agents, and so forth.

In utilizing the novel bleach-fixing solutions of this invention in photographic color processing, care should be taken to ensure that the color developing agent is not carried over into the bleach-fixing solution, as this can result in indiscriminate dye formation in the photographic element. This is readily avoided by the use of a stop bath following the development step, for example, an acetic acid stop bath.

It is a particular advantage of the bleach-fixing solutions of this invention that—with the possible exception of an alkaline buffering agent—no ingredients other than the peroxy compound and the ammonium or amine salt of a weak acid are ordinarily needed for effective performance. Thus, these bleach-fixing solutions are very simple to prepare and of very low cost.

The novel methods and compositions of the present invention can be utilized with any of a wide variety of photographic elements. For a detailed description of useful photographic elements and methods for their manufacture, reference can be made to Research Disclosure, Item 17643, Vol. 176, December, 1978, published by Industrial Opportunities Ltd., Homewell, Havant Hampshire, P09 1EF, United Kingdom.

Photographic color elements often utilize silver halide emulsions of the high bromide type, including silver bromide, silver bromoiodide and silver chlorobromide emulsions. However, as explained in Atwell, U.S. Pat. No. 4,269,927, issued May 26, 1981, high chloride silver halide photographic elements—that is, elements in which the silver halide grains are at least 80 mole percent silver chloride—possess a number of highly advantageous characteristics. For example, silver chloride possesses less native sensitivity in the visible region of the spectrum than silver bromide, thereby permitting yellow filter layers to be omitted from multicolor photographic elements. Furthermore, high chloride silver halides are more soluble than high bromide silver halides, thereby permitting development to be achieved in shorter times.

The bleach-fixing compositions of this invention are especially useful in the processing of high chloride silver halide photographic elements because of the ease with which they are able to dissolve the unexposed silver chloride. Thus, a particularly preferred process within the scope of the present invention comprises the steps of color developing a high chloride silver halide photographic element and bleach-fixing the element in the novel bleach-fixing composition of this invention.

The invention is further illustrated by the following examples of its practice.

EXAMPLE 1

A silver chloride photographic emulsion was spectrally sensitized with anhydro-3-ethyl-9,11-neopentylene-3'-(3-sulfopropyl)thiadicarbocyanine hydroxide (33 mg/mole Ag) and coated on a film support, in an amount providing 1.03 g/m$^2$ of silver and 2.15 g/m$^2$ of gelatin, to thereby form a photographic element. The photographic element was exposed (1/15 sec., 3000° K.) and developed for 1.5 minutes at 31.1° C. in a developing solution having the following composition:

| | |
|---|---|
| Developing agent* | 4.2 g/l |
| Benzyl alcohol | 11.0 ml/l |
| $K_2SO_3$ | 0.2 g/l |
| KCl | 2.1 g/l |
| $H_2SO_4$ | 1.75 g/l |
| pH = 10.05 | |

*4-amino-3-methyl-N—ethyl-N—β-(methanesulfonamido) ethylaniline sulfate hydrate.

The exposed and developed element was treated for 2 minutes with a stop bath consisting of a 1% by weight acetic acid solution, washed for 60 minutes, dried, immersed for 1 minute in a bath containing 20 g/l of $K_2CO_3$, washed for 5 minutes, bleach-fixed for 10 minutes in a bleach-fixing solution of the composition hereinafter described, washed for 5 minutes and dried. The bleach-fixing solution was an aqueous solution having a pH of 8.95 and containing 144.14 g/l of ammonium carbonate and 50.0 ml/l of a 30% by weight aqueous solution of hydrogen peroxide. X-ray diffraction techniques were used to measure the residual silver in the element, and this measurement indicated a residual silver content of 12.3 cg/m$^2$, indicating that the solution functioned effectively as a bleach-fixing bath.

For purposes of comparison, the same photographic element was processed in the identical process except that the bleach-fixing solution contained 30 ml/l of acetic acid and 50 ml/l of a 30% by weight aqueous solution of hydrogen peroxide, and had a pH (adjusted by addition of NaOH) of 4.1. In this case, the residual silver content was 31.9 cg/m$^2$, indicating that this bleach-fixing solution, which is outside the scope of the present invention, was much less effective.

EXAMPLE 2

The photographic element described in Example 1 was processed in the identical process except that the bleach-fixing solution contained 1.19 g/l of ammonium acetate and 12.5 ml/l of a 30% by weight aqueous solution of hydrogen peroxide and had a pH (adjusted by addition of $NH_4OH$) of 11. In this case, the residual silver content was 0.5 cg/m$^2$, indicating the exceptional effectiveness of this particular bleach-fixing solution within the scope of the present invention.

The invention has been described in detail with particular reference to preferred embodiments thereof, but it will be understood that variations and modifications can be effected within the spirit and scope of the invention.

What is claimed is:

1. In a method of processing a photographic color element comprising the steps of color developing and bleach-fixing, the improvement wherein said bleach-fixing step is carried out with a bleach-fixing composition comprising an aqueous alkaline solution of a peroxy compound and an ammonium or amine salt of a weak acid.

2. A method as claimed in claim 1 wherein said peroxy compound is hydrogen peroxide.

3. A method as claimed in claim 1 wherein said photographic color element is a high chloride silver halide element.

4. A method of processing a high chloride silver halide photographic color element which comprises color developing said element in a color developing composition and bleach-fixing said developed element in a bleach-fixing composition comprising an aqueous alkaline solution of hydrogen peroxide and ammonium carbonate.

5. A method as claimed in claim 1 wherein said bleach-fixing composition has a pH in the range of from about 8 to about 12.

6. A method as claimed in claim 1 wherein said bleach-fixing composition has a pH in the range of from about 9 to about 11.

7. A method as claimed in claim 1 wherein said peroxy compound is an alkali metal perborate.

8. A method as claimed in claim 1 wherein said peroxy compound is an alkali metal percarbonate.

9. A method as claimed in claim 1 wherein said salt of a weak acid is ammonium carbonate.

* * * * *